United States Patent [19]

Bertoli

[11] Patent Number: 4,722,570

[45] Date of Patent: Feb. 2, 1988

[54] FOLDING HIGH CHAIR HAVING TWO OR MORE USE POSITIONS

[75] Inventor: Vittorio Bertoli, Telgate, Italy

[73] Assignee: Monbebe' S.r.l., Telgate, Italy

[21] Appl. No.: 5,154

[22] Filed: Jan. 20, 1987

[30] Foreign Application Priority Data

Feb. 3, 1986 [IT] Italy ..... 20804[U]

[51] Int. Cl.[4] ..... A47C 1/027

[52] U.S. Cl. ..... 297/345; 297/153

[58] Field of Search ..... 297/153, 149, 345

[56] References Cited

U.S. PATENT DOCUMENTS

| | | | |
|---|---|---|---|
| 416,324 | 12/1889 | Cross | 297/345 X |
| 703,792 | 7/1902 | Johnston | 297/345 X |
| 3,443,784 | 5/1969 | Walkinshaw | 297/345 X |
| 3,542,419 | 11/1970 | Spinola | 297/345 X |
| 3,682,521 | 8/1972 | Kesling | 297/153 X |
| 4,065,175 | 12/1977 | Perego | 297/345 X |
| 4,165,127 | 8/1979 | Vago | 297/345 |
| 4,408,743 | 10/1983 | DeWitt | 297/345 X |
| 4,510,633 | 4/1985 | Thorne | 297/345 X |
| 4,606,576 | 8/1986 | Jones | 297/153 |

*Primary Examiner*—Peter A. Aschenbrenner

*Attorney, Agent, or Firm*—Laff, Whitesel, Conte & Saret

[57] ABSTRACT

A folding high chair having several use positions comprises a base frame 2 consisting of two pairs of legs 3, 4 substantially disposed in use in the form of an inverted V; a seat 5 provided with a supporting framework 6 slidably engaged, by means of sleeves 10, along the front legs 3 of the base frame 2; a U-shaped control lever 11 provided with two extensions 13 rotatably engaged, at the free ends thereof, with the supporting frame 6 and supported, at an intermediate point thereof, by tension rods 14 rotatably engaged with the upper part of the base frame 2 and also provided with a base crosspiece 12 located between the extensions 13 and operable as a pedal to cause the seat 5 to move from a lowered position to a maximally raised position; fastening means being also provided for rigidly securing said seat to said base frame at predetermined heights thereof.

7 Claims, 7 Drawing Figures

FOLDING HIGH CHAIR HAVING TWO OR MORE USE POSITIONS

FIELD AND BACKGROUND OF THE INVENTION

The present invention relates to a folding high chair adapted to take two or more use positions.

It is known that there are folding high chairs which not only offer the possiblitlity of being folded up but also allow the positioning of the corresponding seat to different predetermined heights.

To this end different types of high chairs have been provided. According to one of them the seat is slidably engaged with a supporting frame consisting of two pairs of front and rear legs respectively disposed in the form of an inverted V. More particularly the seat engages with the front legs by a pair of side members provided with guide elements engaging in turn into sliding grooves extending longitudinally along the front legs themselves.

The fastening of the seat at predetermined levels from the ground is determined by the presence on each side member of a pin which being urged by a spring is designed to be snap fitted into suitably arranged housings on the corresponding front leg. Said pins pass across the respective side members and end in control knobs; by manually acting upon the latter it is possible to disengage the pins from the corresponding housings and, as a result, lower or raise the seat relative to the supporting frame.

From the foregoing description it is apparent that in the high chairs of the above type the lowering and raising operations for the seat are rather uncomfortable as the user is obliged to act simultaneously, using both hands, on the two knobs in order to disengage the respective pins from the corresponding housings.

In addition and above all during this step the user by holding the only knobs must also support the seat so that it may not suddenly slide down along the front legs. It can be easily realized that such a situation is particularly uncomfortable and unsteady when said operations are carried out while a child is sitting on the seat.

Another type of two-position high chair comprises a base frame made up of suitably shaped tubular elements fastened to one another, one seat being engaged therewith by means of two pairs of rods. The seat-frame-rod assembly substantially forms a linkage parallelogram. As a result, the seat can take two different use positions at different levels from the ground carrying out displacements with respect to the base frame by the combined action of horizontal and vertical movements.

Advantageously one of the pairs of said rods consists of the end portions of a U-shaped control lever, the transverse portion of which is located at the back of the high chair and can be operated as a pedal in order to raise the seat. In this mode it is possible to raise said seat and to guide the descent thereof by merely exerting a foot pressure on said crosspiece even when a child is sitting thereon.

The above features make the high chair in question very comfortable in use, being impossible to find this characteristic in the other high chairs of known type.

However the assembling of the seat on the base frame by means of parallelogram-shaped rods gives the whole high chair a precarious stability during the displacement steps thereof. In fact it is clear that during such operations the seat is obliged to follow trajectories that cause important displacements of the center of gravity concerning the whole high chair. Such a situation can involve important dangers if the seat is moved while the child is sitting thereon.

It is also important to note that said high chair does not offer any protection in the event that during the raising and/or lowering step the user should accidentally lose the foot hold on the control lever. In this case the seat would be subjected to a sudden drop.

OBJECT

Under this situation, the object of the present invention is to eliminate the drawbacks proper to high chairs of known type, by providing a high chair adapted to ensure a high safety degree together with a very comfortable manner of use either in normal employment conditions or when the seat has to be lowered and raised.

SUMMARY OF THE INVENTION

The foregoing and still further objects that will become more apparent in the following are substantially attained by a folding high chair having two or more use positions of the type comprising a base frame consisting of two pairs of legs substantially disposed in use in the form of an inverted V, a seat provided with a supporting framework slidably engaged with said base frame and movable in a substantially vertical direction from a lowered position to a maximally raised position with respect to the base frame itself, fastening means for rigidly securing said seat to said base frame at predetermined heights thereof, as well as safety means capable of preventing the accidental disengagement of said fastening means, wherein said high chair further comprises a substantially U-shaped control lever located at the back of the base frame and essentially consisting of a base crosspiece, operated as a pedal and provided with two substantially parallel extensions rotatably engaged, at the free ends thereof, with said supporting frame and supported, at an intermediate point thereof, by respective tension rods, the ends of said tension rods opposite said extensions being each rotatably fitted into the upper part of said base frame.

BRIEF DESCRIPTION OF THE DRAWINGS

Further features and advantages of the invention will become more apparent from the detailed description of a preferred but not exclusive embodiment of a folding high chair having two or more use positions, given hereinafter by way of non-limiting example with reference to the accompanying drawings, in which.

DESCRIPTION OF THE PREFERRED EMBODIMENT

Figure 1:
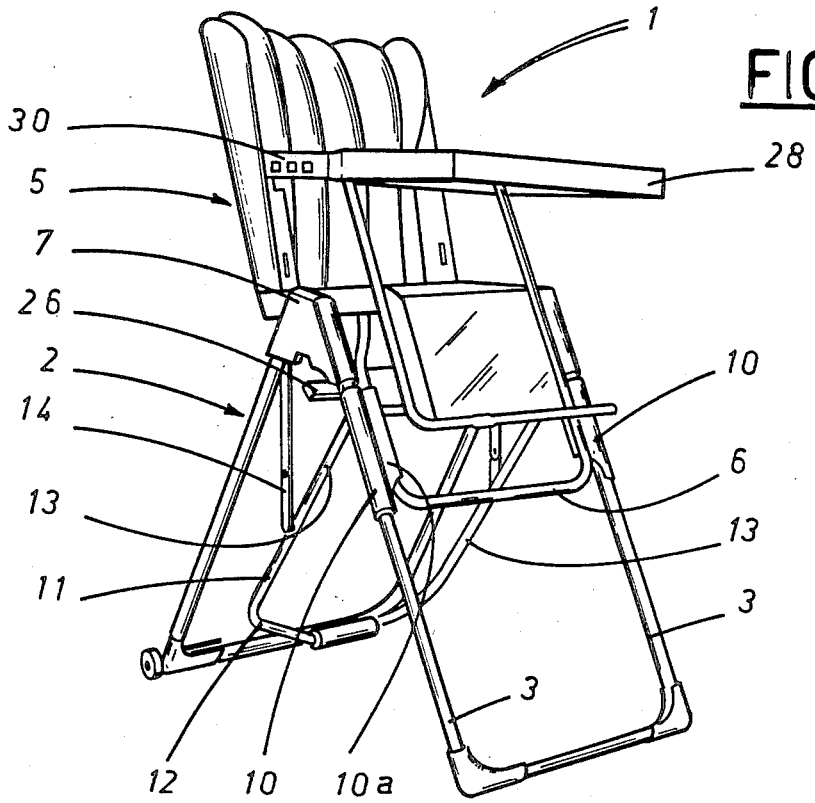
FIG. 1 is a perspective view of the high chair in question with the seat at its maximally raised position.

Referring to the drawings, reference numeral 1 denotes a folding high chair according to the present invention, having two or more use positions.

It comprises a base frame 2 substantially consisting of two pairs of front 3 and back 4 legs respectively, disposed in the form of an inverted V, as well as a seat 5 provided at its lower part with a supporting framework 6 slidably engaged with the front legs 3.

Figure 7:
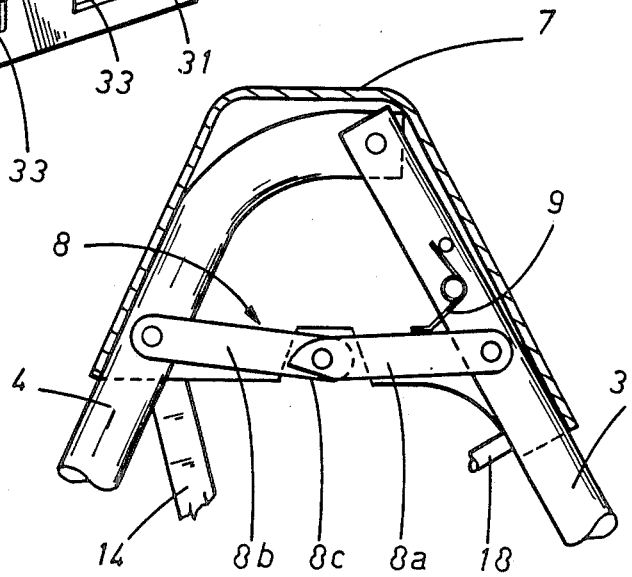
FIG. 7 is a side view of a detail relative to the high chair legs.

As shown in FIG. 7, the legs 3 and 4 are rotatably fitted into each other, two by two, in the region of their upper ends where a covering element 7 is located the shape of said element 7 being adapted to create a given angle, in use, between the legs 3 and 4. Between said legs is also disposed a locking plate 8 known in itself and acting so as to keep the legs 3 and 4 in their open position. In greater detail, each locking plate 8 is essentially comprised of two articulated bars 8*a* and 8*b* fitted into each other and into the corresponding legs 3 and 4.

Figure 4:
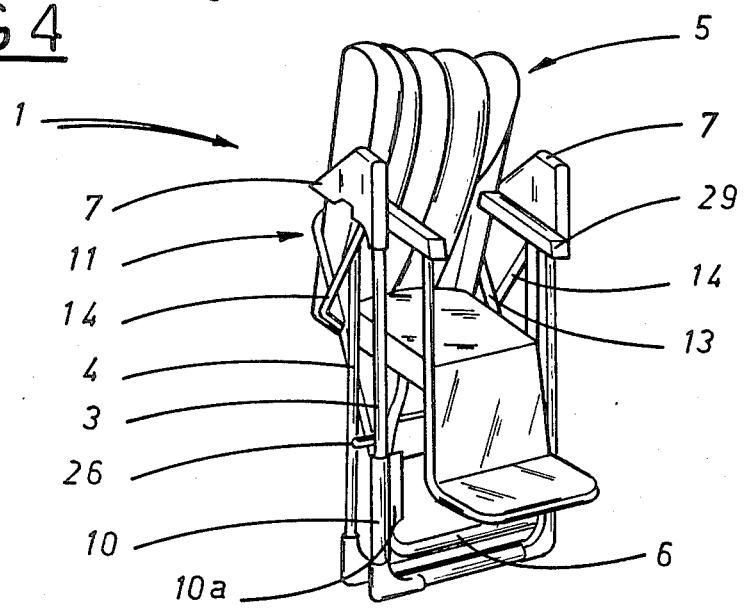
FIG. 4 is a perspective view of the high chair when folded up.

A torsion spring 9 acts on the rod 8*a;* it is mounted on the corresponding front leg 3 and acts so that it urges the rod 8*a* downwards with reference to FIG. 7. It is clear that under this situation it is impossible to move the legs 3 and 4 close to each other by directly acting on the same. In fact, in order to obtain said side-by-side arrangement of the legs (which corresponds to the folding up of the high chair, as shown in FIG. 4) it is necessary to act first on the point of engagement between the articulated bars 8*a* and 8*b* thrusting them upwards.

When legs 3 and 4 are moved again to their use position the spring 9 automatically carries out the appropriate positioning of the articulated bars 8*a* and 8*b*.

As seen in the figures, the seat 5 is mounted on the base frame 2 by means of a pair of sliding sleeves 10 slidably engaged along the front legs 3 and fastened to the supporting framework 6 in the region of corresponding connection flanges 10*a*. The seat 5 is therefore movable in a substantially vertical direction, following an inclined plane containing the front legs 3.

Advantageously, the high chair 1 comprises a substantially U-shaped control lever 11 located at the back of frame 2 and consisting of a base crosspiece 12 operable as a pedal and of two substantially parallel extensions 13. The control lever 11 is rotatably fitted, through the free ends 13*a* of its extensions 13, into the supporting framework 6, whereas an intermediate point of said projections 13 engages with a pair of tension rods 14. Tension rods 14 are in turn rotatably engaged with the upper ends of the respective rear legs 4.

According to a preferred embodiment, tension rods 14 are made of two mutually articulated portions in order to allow the control lever 11 to move close to the seat 5 back when the high chair 1 is folded up, as seen in FIG. 4.

Advantageously, the raising and lowering of seat 5 can be achieved by exerting a light foot pressure on the crosspiece 12 of the control lever 11.

Figure 5:
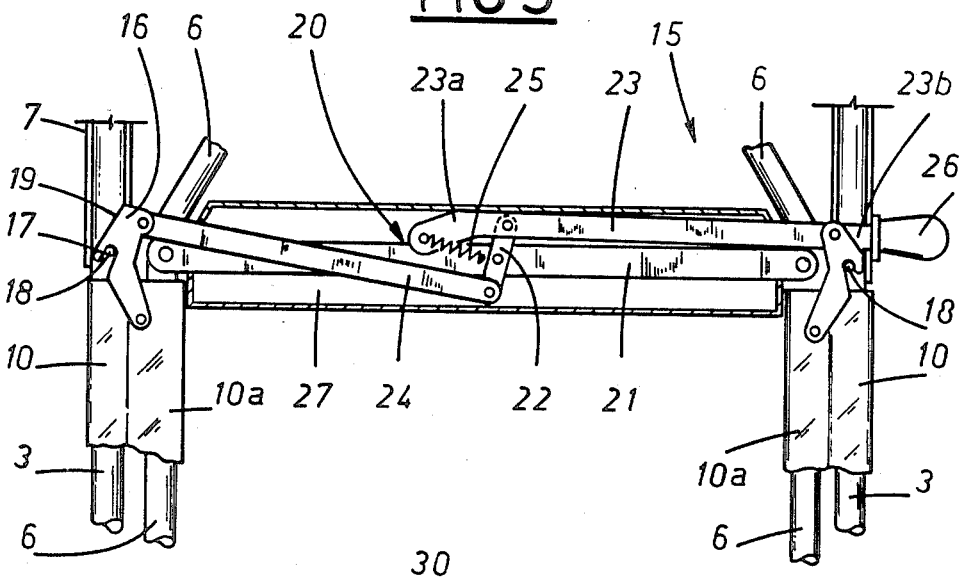
FIG. 5 is a part sectional view of a hooking device being part of the high chair in question.

The locking of the seat to a given position at a predetermined height is obtained through fastening means globally identified by reference numeral 15 and shown more clearly in FIG. 5. As is possible to see, said fastening means 15 comprises a pair of hooking elements 16 carried each by the seat 5, close to one of the front legs 3.

In greater detail, each hooking element 16 is fitted into the connection flange 10*a* of the respective sleeve 10 oriented towards the back of the high chair 1, and is made up of a shaped plate provided with an engagement housing 17 designed to receive a fastening peg 18 fixed at a predetermined height on the corresponding front leg 3.

Furthermore, on the profile of each hooking element 16 and exactly on its portion oriented sideways and towards the outer part of the high chair 1, on up-pointing flat 19 is defined, for the purposes to be specified later.

The hooking elements 16 are linked to each other by a control linkage 20 comprising a supporting crosspiece 21 fixed to the supporting framework 6 in the region of the hooking elements 16. A transmission plate 22 is fitted in the middle of the supporting crosspiece 21; the opposite ends of said plate are linked to two connecting rods 23 and 24 respectively which in turn rotatably engage with the respective hooking elements 16 at the upper ends thereof.

The connecting rod 23 is provided with a first extension 23*a* and a spring 25 mounted on the supporting crosspiece 21 acts thereon. Said spring 25 acts in such a manner that it urges the connection rod 23 in a longitudinal direction, in order to push the respective hooking element 16 towards the corresponding fastening peg 18. The same effect is simultaneously obtained on the connecting rod 24.

The connecting rod 23 is also provided with a second extension 23*b* projecting sideways towards the outer part of the high chair 1 which ends in a control knob 26.

The whole control linkage 20 is surrounded by a box-shaped receptacle 27.

According to a preferred embodiment the high chair 1 is provided with only one pair of fastening pegs 18 located, as shown in FIG. 7, each on one of the front legs 3 in the region of the covering element 7 in order to lock the seat 5 in its position of maximum raising from the ground.

When during the seat raising step the hooking elements 16 come close to the fastening pegs 18 said pegs are urged to slide along the inclined flats 19 of the hooking elements 16. After the hooking elements 16 have moved past the fastening pegs 18, their housings 17 engage with the said fastening pegs by effect of the springs 25. Afterwards, when the operator's action on the control lever 11 ceases, there is a slight descent of the seat 5 and the final settlement between the fastening pegs 18 and the engagement housings 17 takes place.

When the seat 5 is wished to be brought to its lower position, it is first necessary to act on the control lever 11 so as to slightly raise the seat 5 in order to disengage the fastening pegs 18 from their engagement housings 17. Then, pushing the control knob 26 towards the inner part of the high chair 1 the above disengagement takes place and the seat 5 can be guided during its descent holding the foot on the control lever 11.

Figure 2:
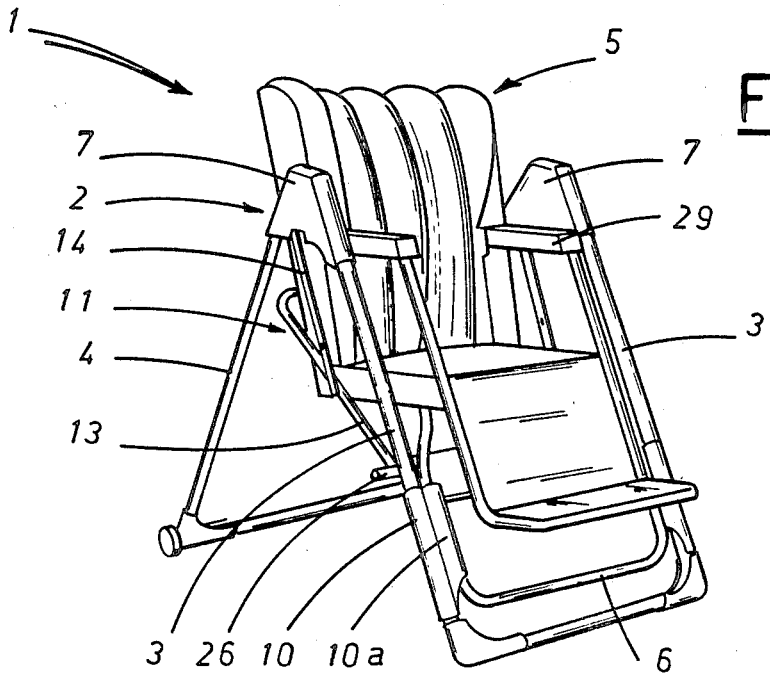
FIG. 2 is a perspective view of the high chair with the seat at its lowered position and devoid of the front tray.
Figure 3:
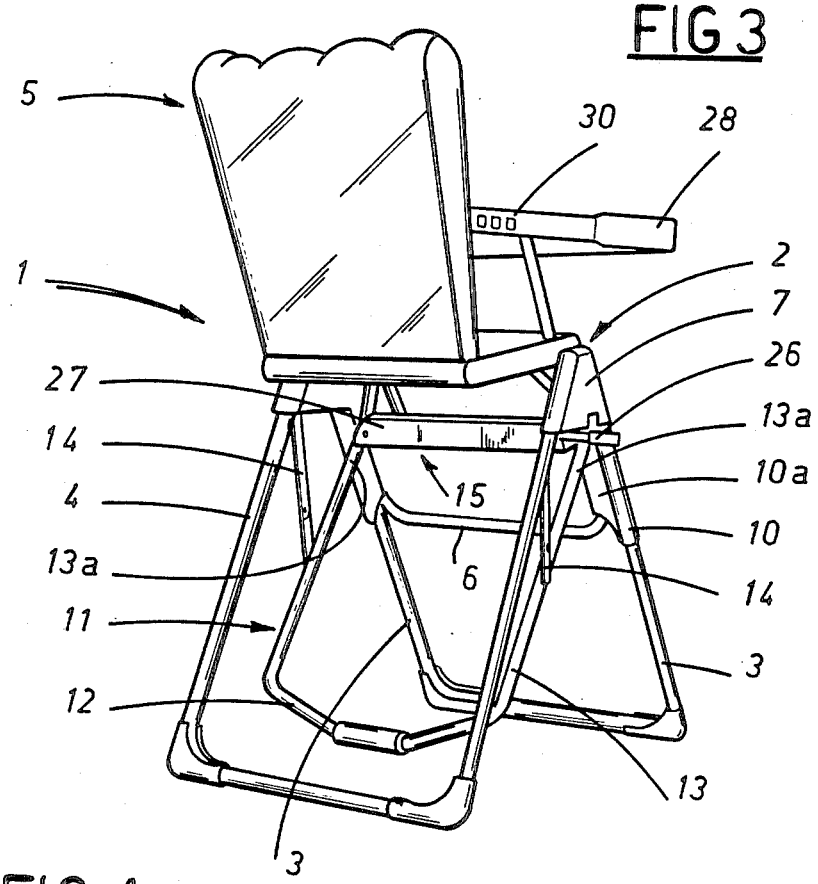
FIG. 3 is a perspective view of the high chair from the back and with the seat at its maximally raised position.
Figure 6:
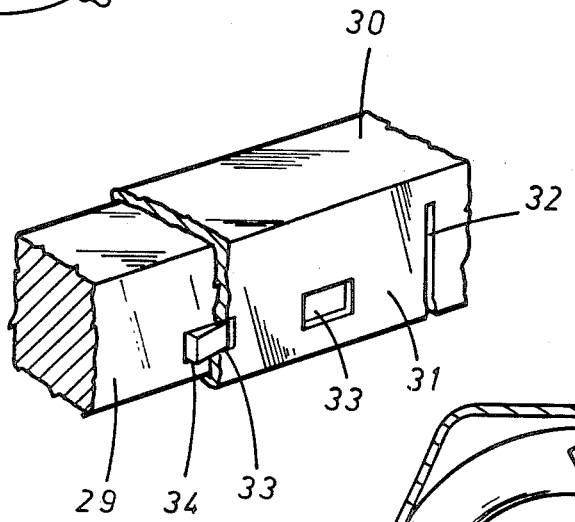
FIG. 6 shows the connection between the tray and the seat arm in more detail and in a perspective view.

According to a further feature of the present invention, the high chair 1 comprises a front tray 28 engageable in a removable manner with the chair arms 29. In greater detail, as shown in FIGS. 1, 2 and 6, the tray 28 is engaged with arms 29 by means of two parallel extensions having the form of an inverted U when seen in section.

Advantageously, at least one side 31 of each extension 30 is flexible, said flexibility being achieved by means of a transverse notch 32.

In addition on said flexible side 31 provision is made for a number of aligned slots 33 suitably spaced apart from each other and into which a fitting lug 34 carried by arm 29 engages in a removable manner and selectively, depending upon the mutual positioning between tray 28 and seat 5.

Advartageously and as shown in the figures, each fitting lug 34 has a wedge-shaped conformation projecting from the respective arm 29 by an increasing degree in the direction of the seat back. In virtue of the conformation of said lugs 34, the tray 28 can be moved towards the seat back by sliding. If on the contrary tray 28 has to be moved far from said seat back or removed therefrom it is necessary to pull it taking care of slightly opening the flexible sides 31 wide apart from arm 29; in this way the fitting lugs 34 are no longer in contact with the slots 33.

The present invention attains the intended purposes.

In fact, owing to the presence both of a movable seat sliding along the base frame and of the above described control lever, the high chair according to the invention exhibits qualities of safe and comfortable use it is not possible to find in high chairs of the known art.

In this connection it will be recognized that the moving of the seat 5 along the base frame 2 always takes place under the highest safety conditions since the high chair 1 is not subjected to displacements of the center of gravity sufficient to involve risks of instability.

In addition, as the seat 5 is slidable along an inclined flat it can never be subjected to a sudden drop even if the operator's foot should accidentally miss its hold on the control lever 11 during a seat transferring step.

Due to the particular conformation of the hooking elements 16 and more specifically to the vertical extension of the engagement housings 17 it is impossible for the knob 26 to be accidentally operated before the control lever 11 has been steadily held and this feature gives the chair a high safety degree.

Obviously many modifications can be made to the high chair 1 a11 falling within the scope of the inventive idea.

What is claimed is:

1. A folding high chair having several use positions and comprising a base frame consisting of two pairs of legs substantially disposed in use in the form of an inverted V, a seat provided with a supporting framework slidably engaged with said base frame and movable in a substantially vertical direction from a lowered position to a maximally raised position with respect to the base frame itself, fastening means for rigidly securing said seat to said base frame at predetermined heights thereof, as well as safety means capable of preventing the accidental disengagement of said fastening means, wherein said high chair further comprises a substantially U-shaped control lever located at the back of the base frame and essentially consisting of a base crosspiece, operated as a pedal and provided with two substantially parallel extensions rotatably engaged, at the free ends thereof, with said supporting frame and supported, at an intermediate point thereof, by respective tension rods, the ends of said tension rods opposite said extensions being each rotatably fitted into the upper part of said base frame.

2. The high chair as claimed in claim 1, comprising two sliding sleeves rigidly connected to said supporting framework and slidably engaged with the front legs of said base frame.

3. The high chair as claimed in claim 1, wherein said fastening means comprises at least one pair of hooking elements carried by said seat and rotatably fitted in the vicinity of said front legs, said hooking elements being provided with respective engagement housings extending substantially in a verbical direction and adapted to recieve fastening pegs located on said front legs at predetermined heights thereof and being linked to each other by a control linkage consisting of a transmission plate rotatably engaged, at an intermediate point thereof, with a supporting crosspiece and, at the free ends thereof, with two connecting rods; each of said connecting rods rotatably engaging with one of said hooking elements and at least one of said connecting rods being provided with an extension projecting from the high chair and being also linked to a spring mounted on said supporting crosspiece and acting so as to thrust said hooking elements towards their respective fastening pegs.

4. The high chair as claimed in claim 3, wherein said control linkage is surrounded by a box-shaped receptacle.

5. The high chair as claimed in claim 1, wherein each of said tension rods is substantially comprised of two portions rotatably fitted into each other.

6. The high chair as claimed in claim 1, wherein said seat is provided on each of its arms with a fitting lug adapted to be inserted into a slot being part of a plurality of slots located on the parallel extensions of a front tray which in section have the form of an inverted U.

7. The high chair as claimed in claim 6, wherein each of said fitting lugs has a wedge-shaped profile, projecting from the respective arm by an increasing degree in the direction of the seat back.

* * * * *